United States Patent [19]

Woolbright

[11] 4,296,664

[45] Oct. 27, 1981

[54] SOUND BROADCASTING APPARATUS

[76] Inventor: Kenneth O. Woolbright, 5601 NW. 37th, Oklahoma City, Okla.

[21] Appl. No.: 95,424

[22] Filed: Nov. 19, 1979

[51] Int. Cl.[3] ..... G10H 1/42; G10H 7/00

[52] U.S. Cl. ..... 84/1.03; 84/1.28; 84/DIG. 12

[58] Field of Search ..... 84/1.01, 1.03, 1.24, 84/DIG. 12, 1.28

[56] References Cited

U.S. PATENT DOCUMENTS

| | | | |
|---|---|---|---|
| 4,022,097 | 5/1977 | Strangio | 84/1.03 |
| 4,043,240 | 8/1977 | Ando | 84/1.01 |
| 4,090,349 | 5/1978 | Takase | 84/1.01 X |
| 4,110,750 | 8/1978 | Heyning et al. | 84/1.01 X |
| 4,135,423 | 1/1979 | Gross | 84/1.03 |

*Primary Examiner*—Stanley J. Witkowski
*Attorney, Agent, or Firm*—Robert M. Hessin

[57] ABSTRACT

An apparatus for reproducing sound from data which are electrically stored in an electronic memory is disclosed. This sound reproducing apparatus includes a member for providing timing control to associated electronic circuitry. There is also a member for retrieving the individual elements of the data from the memory and electronic components for converting the retrieved elements into respective audio signals. Furthermore, there are electrical circuit elements for audibly broadcasting the respective audio signals. The duration of the broadcasting of each respective signal is controlled by a circuit which is responsive to the timing control member and the retrieved elements. The present invention may also broadcast sounds from externally input signals. This is effected through an external source element for obtaining such external input and a switch means for connecting either the stored elements retrieved from the memory or the external input from the external source to the audible broadcasting member.

9 Claims, 3 Drawing Figures

SOUND BROADCASTING APPARATUS

BACKGROUND OF THE INVENTION

1. Field of the Invention

This invention relates generally to sound broadcasting apparatus and more particularly, but not by way of limitation, to a portable electric horn for broadcasting songs which are electronically stored within the horn and for broadcasting live sounds over a microphone connectible to the horn.

2. Description of the Prior Art

Sound broadcasting apparatus provide a useful way for communicating speech, music and other sounds to people. To provide such a broadcasting apparatus which is also versatile creates the need for a device which is portable and which can broadcast both live and recorded sounds. So that a variety of recorded songs can be broadcast with clarity, such a device needs to be sophisticated enough to provide appropriate tempo, pitch and volume controls for accurately reproducing the sounds.

The device also needs to be sophisticated enough to control itself once a recorded segment has been selected for broadcasting. This need includes providing a device with means for automatically controlling the duration which each element within the selected segment is broadcast.

Although the device must be sophisticated, it must be relatively simply constructed so that it is portable and easily maintainable. The portability and easy maintainability needs of such a device raise the further need for using solid-state integrated circuit memories to store the recorded sounds in the sound broadcasting apparatus.

Some devices have been previously proposed in attempts to meet one or more of these needs. One such proposal is a simple public address system including a microphone, a power amplifier, and a loud-speaker. Systems which have included electronic memories have also been proposed.

U.S. Pat. No. 4,090,349 in the name of Takase discloses an electronic music box having a memory which is proposed to be energized in a predetermined manner by output signals from a pulse generator. The contents of the memory cells are arranged in a given melody. During the proposed operation of this device, output signals from a musical scale signal circuit and signal level selection circuit are supplied to a loud-speaker to generate sound.

U.S. Pat. No. 4,022,097 in the name of Strangio discloses a computer-aided musical apparatus and method. The Strangio patent proposes that electronically stored coded data be successively released in correspondence with the successive notes and the rhythm of a particular musical composition. The proposed apparatus for accomplishing this includes means for decoding the stored data, converting the stored data into oscillating electrical signals, and converting the electrical signals into broadcasted audible tones.

Another proposed electronic device is disclosed in U.S. Pat. No. 4,043,240 in the name of Ando to include a binary counter which is cleared when the counts within the counter reach integers representative of a melody.

SUMMARY OF THE INVENTION

The present invention is portable and can broadcast both live and recorded sounds. The device is sophisticated so that it can provide the appropriate tempo, pitch and volume control to accurately reproduce the recorded sounds to be broadcast.

The present invention is also sophisticated enough to control itself once a recorded segment has been selected for broadcasting. Furthermore, the present invention includes means for automatically controlling the duration of time each element of a selected segment is broadcast.

Although the present invention includes all of these features, it is relatively simply constructed so that it is portable and easily maintainable. This construction includes solid-state integrated circuit memories for storing the recorded sounds.

The present invention provides an apparatus for reproducing sound from data which is electrically stored in an electronic memory device. This sound reproducing apparatus generally includes timing control means, means for retrieving the individual elements of the data from the memory, means for converting the retrieved elements into respective audio signals, means for audibly broadcasting the respective audio signals, and means responsive to the timing control means and the retrieved elements for controlling the retrieving means and the duration of the audible broadcasting of each of the respective audio signals. Furthermore, the apparatus may also include, for the purpose of reproducing sound from externally input signals, an external program source and means for switchably connecting either the retrieved element converting means or the external program source to the audible broadcasting means.

More particularly, the present invention includes electronic devices which provide power, timing and reset control to the apparatus. There are electronic devices which control the duration each element is broadcast and which control the sequence in which each element is read from the internal memory and broadcast over the audible broadcasting means. The apparatus further includes electronic circuit devices which decode the elements read from the internal memory and which generate an audio signal in response to the decoded elements. The output from the circuit which generates the audio signal is switchably coupled with the output from the external program source to an electronic amplifier circuit for amplification prior to broadcasting. Included within these electronic circuits are tempo, pitch and volume control members.

From the foregoing, it is a general object of the present invention to provide a novel, useful and improved sound broadcasting apparatus. Other and further objects, features and advantages of the present invention will be readily apparent to those skilled in the art upon a reading of the description of the preferred embodiment which follows, when taken in conjunction with the accompanying drawings.

DETAILED DESCRIPTION OF THE PREFERRED EMBODIMENT OF THE INVENTION

Figure 1:
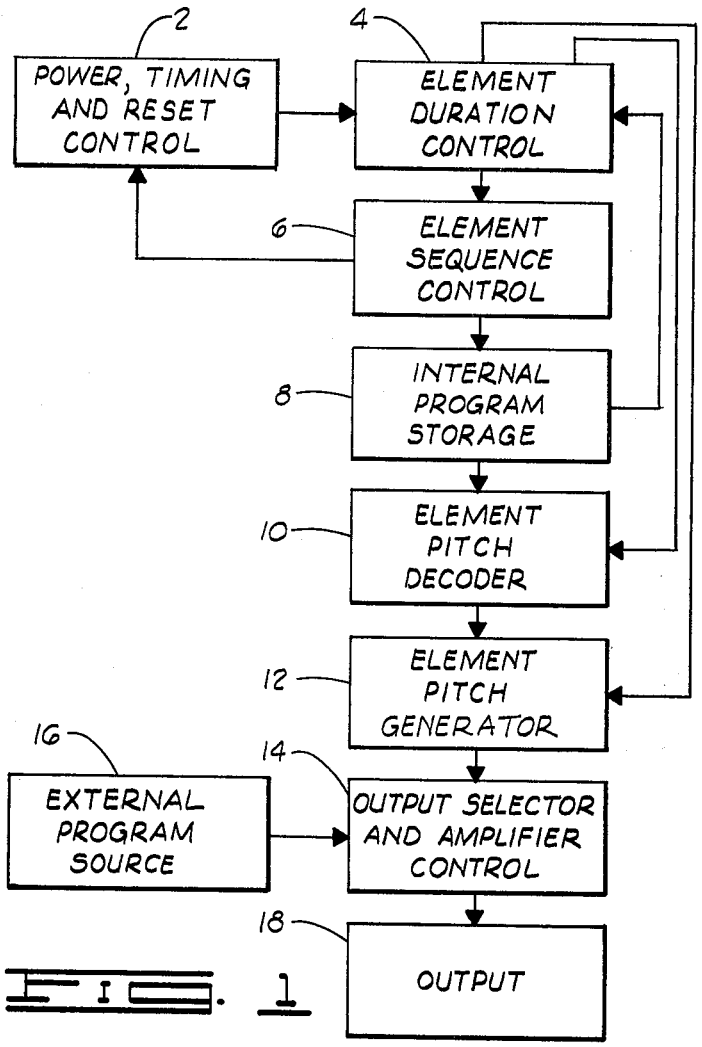
FIG. 1 is a functional block diagram of the elements of a preferred embodiment of the present invention.

With reference now to the drawings, the preferred embodiment of the present invention will be described. FIG. 1 shows the functional block diagram of the preferred embodiment of the sound broadcasting apparatus which can broadcast both recorded and live sounds. The elements of the block diagram include a power, timing and reset control means 2 which is associated with an element duration control means 4 and an element sequence control means 6. FIG. 1 further shows that the apparatus includes an internal program storage means 8 which is responsive to signals from the element sequence control means 6 and which provides control information to the element duration control means 4. The internal program storage means 8 also provides signals to an element pitch decoder means 10 which receives a control signal from the element duration control means 4 and which provides input to an element pitch generator means 12. The element pitch generator means 12 also receives input from the element duration control means 4. The element pitch generator means 12 provides an output to an output selector and amplifier control means 14 which also receives an output from an external program source means 16. Depending upon the status of the output selector, the output selector and amplifier control means 14 provides an amplified signal from either the element pitch generator means 12 or the external program source means 16 to an output means 18. Each of these functional elements will be more particularly described with reference to FIG. 2.

Figure 2:
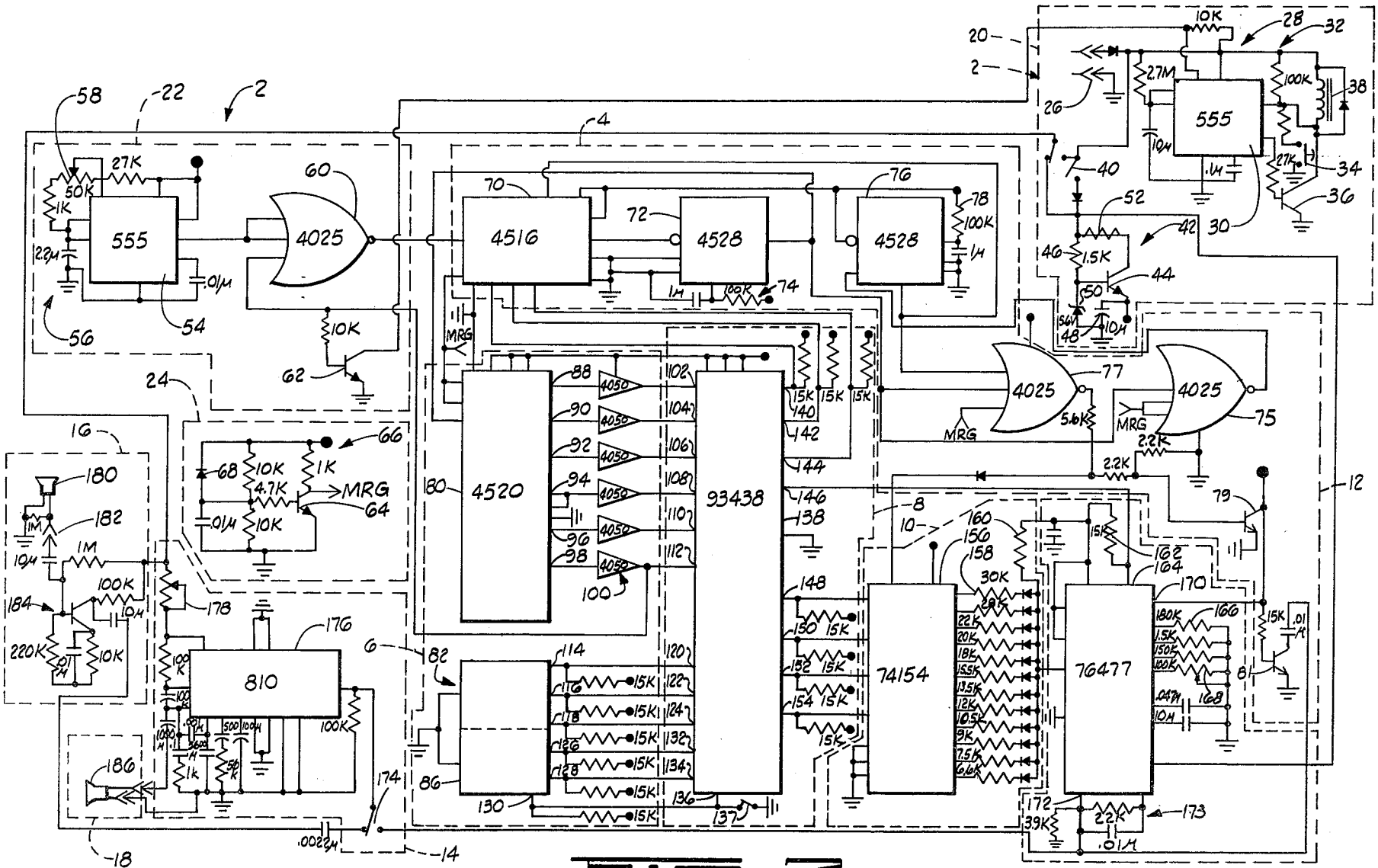
FIG. 2 is a schematic diagram of the electronic circuit of the preferred embodiment of the present invention.

FIG. 2 discloses that the power, timing and reset control means 2 includes a power circuit 20, a timing circuit 22, and a reset circuit 24.

The power circuit 20 includes a pair of power supply input jacks 26 for connecting the apparatus to a main power supply. In the preferred embodiment disclosed in FIG. 2, the main power supply may be a 13.8-volt, one-ampere direct current power supply. When the apparatus is used as a portable sound broadcasting device, this power supply should be embodied as a battery-pack which is attachable to the main apparatus. The power supply is connected through the jacks 26 to an activation signal generator 28.

The activation signal generator 28 includes a first timer 30, such as a first NE555 integrated circuit timer. The signal generator 28 further includes a first resistor-capacitor network 32 which is connected to the timer 30 as is known by those having ordinary skill in the art to establish a pulse having a predetermined duration when the timer 30 is activated.

For activating the timer 30, the power circuit 20 includes an activation switch 34. When the timer 30 is activated by depressing the switch 34 to thereby connect the appropriate timer 30 input to the electric ground, an output of the timer 30 drives a first transistor 36 to energize a relay having a coil 38 and a double-pole switch 40. The energization causes the switch 40 to switch so that a voltage regulator 42 is connected to the main power supply.

The voltage regulator 42 includes a second transistor 44, a first resistor 46, a first capacitor 48, a zener diode 50 and a fuse 52. These voltage regulator elements are connected as is known in the art to provide a regulated 5-volt output at the emitter of the transistor 44. This output is indicated in FIG. 2 by the relatively large black dot depending from the junction between the emitter of the transistor 44 and the capacitor 48. This 5-volt output is connected throughout the circuit to those elements shown having corresponding relatively large black dots, and as otherwise appropriate. These connections may be made by means of a 5-volt power bus distributed throughout the electronic circuit.

FIG. 2 indicates that the timing circuit 22 includes an oscillating signal generator 54, such as a second 555 integrated circuit timer. Connected to the oscillating signal generator 54 is a second resistor-capacitor network 56 which establishes the frequency of the oscillating signal generated by the signal generator. The frequency of this output determines the tempo at which the recorded sounds stored within the internal program storage means 4 are broadcast. So that the tempo may be varied, the network 56 includes a tempo control member 58, such as the potentiometer shown in FIG. 2. Therefore, these elements of the preferred embodiment constitute a timing control means which includes tempo means for providing within the apparatus an electrical signal having a selectable one of a plurality of substantially constant frequencies and means for selecting one of these frequencies.

Completing the timing circuit 22 are a first logic gate 60, such as a NOR gate, and a third transistor 62. At least one input of the logic gate is connected to the output of the oscillating signal generator 54. The collector of the third transistor 62 is connected to the reset input of the first timer 30 within the activation signal generator 28. The base of the transistor 62 and another input of the logic gate 60 are connected to receive a signal from the element sequence control means 6.

The reset circuit 24 of the power, timing and reset control means 2 is shown in FIG. 2 to include a fourth transistor 64 to which is connected a third resistor-capacitor network 66. The network 66 also includes a diode 68. The resistor-capacitor network 66 and the diode 68 are connected to the transistor 64 to generate a high logic level pulse at the collector of the transistor 64 when power is first applied to the apparatus via the power circuit 20. This high logic level pulse exists until the capacitor within the network 66 is charged to a sufficiently high voltage to saturate the transistor 64 and thereby pull the collector voltage of the transistor 64 to a low logic level. This output from the transistor 64 is labeled in FIG. 2 as the master reset generator signal (MRG).

FIG. 2 shows that the connection between the power, timing and reset control means 2 and the element duration control means 4 as depicted in FIG. 1 is provided by connecting the output from the timing circuit 22 to a first counter 70. The first counter 70 initially may be cleared by its connection to the MRG signal as shown in the figure and then preset with a starting count which is provided by the internal program storage means 8. The output from the first counter 70 is connected to the input of a first pulse generator 72.

The first pulse generator 72 generates a pulse having a duration which is determined by a fourth resistor-capacitor network 74 connected thereto. The output from the first pulse generator 72 is connected to the element sequence control means 6 and to respective inputs of a second logic gate 75 and a third logic gate 77, such as the NOR gates shown in FIG. 2.

The logic gate 75 has its other inputs connected to the MRG signal at the collector of the transistor 64. The output of the gate 75 is connected to an input of a second pulse generator 76.

The logic gate 77 has another of its inputs connected to the MRG signal and a third input connected to an output from the second pulse generator 76. The output of the gate 77 is connected through the circuit elements shown in FIG. 2 to the element pitch decoder 10 and to the base of a fifth transistor 79. This logic gate-transistor connection provides the control signal between the element duration control means 4 and the element pitch decoder depicted in FIG. 1. It also provides this control signal to a sixth transistor 81.

The second pulse generator 76 generates, in response to an appropriate input signal from the logic gate 75, a pulse having a duration which is determined by a fifth resistor-capacitor network 78 connected thereto. The output of the second pulse generator 76 is connected, in addition to the input of the logic gate 77, to the load input of the first counter 70 for controlling the loading of the starting count into the first counter 70 from the internal program storage means 8.

The element sequence control means 6 of the preferred embodiment is a means for retrieving individual elements of the recorded data which are stored in the internal program storage means 8. This retrieving means sequentially retrieves the stored elements in accordance with the output of a second counter 80 and a first switch means 82.

The second counter 80 has its count increment input connected to the output of the first pulse generator 72. Thus, the second counter 80 is responsive to the first counter 70 through the first pulse generator 72. As the second counter 80 responds to this input, it sequentially increments through the plurality of program elements contained within the internal program storage means 8. FIG. 2 also discloses that the second counter 80 has a reset input to which is connected the MRG signal from the reset circuit 24. The second counter 80 further includes outputs 88, 90, 92, 94, 96, and 98. Each of these outputs is connected to a respective one of a plurality of integrated circuit buffer devices 100. The outputs 88, 90, 92, 94 and 96 are connected through their respective buffers 100 to respective address inputs 102, 104, 106, 108 and 110 of the internal program storage means 8. The output 98 is connected through its respective buffer 100 to an enable input 112 of the internal program storage means 8 and also to an input of the logic gate 60 and to the base of the transistor 62 (through a resistor) within the timing circuit 22. Thus the counter 80 can address any one of thirty-two ($2^5$) addresses within the internal program storage means 8 when the storage means is enabled via the output 98-input 112 connection.

To supplement the second counter 80 so that a number of different 32-address storage areas within the internal program storage means 8 may be accessed, the retrieving means embodied within the element sequence control means 6 includes the first switch means 82. In the FIG. 2 preferred embodiment, the switch means 82 includes two thumbwheel switches 84 and 86. Each of these switches can be used to address up to eight locations as indicated by the three connections extending between each of the switches 84 and 86 and the internal program storage means 8. FIG. 2 more particularly shows that the first thumbwheel switch 84 includes outputs 114, 116, and 118 which are each connected to a respective one of address inputs 120, 122, and 124 of the internal program storage means 8. Likewise, the second thumbwheel switch 86 includes outputs 126, 128, and 130 which are connected to respective ones of address inputs 132, 134, and 136 of the internal program storage means 8. Each of these connections includes a respective pull-up resistor as shown in FIG. 2 and is known in the art. It is to be noted that FIG. 2 indicates that the output 130-input 136 connection is connected to ground by means of an electrical strap 137. This limits the addressing flexibility of the second thumbwheel switch 86 to only four addresses. This strap is included in the FIG. 2 preferred embodiment because of the limited storage space within the preferred embodiment storage means 8. However, if this storage area were increased, the strap 137 could be broken to permit the switch 86 to have it full range of addressing flexibility.

The address inputs 102-110, 120-124 and 132-136 form a portion of an electronic memory element 138 which constitutes the preferred embodiment of the internal program storage means 8. In the FIG. 2 preferred embodiment, the memory 138 is a solid-state integrated circuit memory such as a programmable-read-only-memory, an erasable-programmable-read-only-memory, a read-only-memory, or any other suitable device which may have digitally encoded program elements stored therein and which may be easily replaceable with different units having different programs stored thereon. FIG. 2 discloses that the memory 138 also includes data outputs 140, 142, 144, 146, 148, 150, 152 and 154. The data outputs 140, 142 and 144 are the outputs at which duration memory elements are presented and are connected with appropriate pull-up resistors to three of the data inputs of the first counter 70 for loading the initial count therein. The output 146 is connected to the element pitch generator means 12 and the element pitch decoder means 10. The outputs 148–154 are the outputs at which pitch memory elements are presented and are connected with appropriate pull-up resistors to respective inputs of the element pitch decoder means 10. Each respective combination of duration memory elements and pitch memory elements constitutes a musical word which has been stored within the memory 138 so that it may be accessed when appropriately addressed by the element sequence control means 6. When a word is accessed, the duration memory element thereof is used by the element duration control means 4 to control the length of time an audio signal corresponding to the pitch memory element of the accessed word is generated and broadcast through the element pitch decoder 10, element pitch generator 12 and succeeding components functionally depicted in FIG. 1 and schematically shown in FIG. 2.

The element pitch decoder means 10 includes an integrated circuit device 156 which decodes the pitch memory elements transferred to its inputs from the memory 138 outputs 148–154 into a substantially equivalent single-conductor analog current signal by means of an array of resistors 158 connected to the outputs of the integrated circuit 156. The array of resistors has a common junction at the end of the resistors opposite their connections to the integrated circuit 156. This junction is connected through resistors 160 and 162 to the output 146 of the memory 138. Thus, the element pitch decoder means 10 converts the digitally formatted pitch memory elements retrieved from the memory 138 into a substantially equivalent analog format for driving the element pitch generator means 12. In different embodiments of the present invention, the element pitch decoder means 10 may be deleted and the output from the memory 138 may be used to directly drive an element pitch generator means.

The element pitch generator means 12 shown in the preferred embodiment of FIG. 2 includes an integrated circuit audio signal generator 164 which is responsive to the current signal generated by the integrated circuit member 156 and the array of resistors 158. The audio signal generator 164 includes an input to which the output 146 from the memory 138 is connected. The generator 164 further has connected thereto an array 166 of resistors and capacitors. The array 166 includes a pitch control member 168, such as the potentiometer shown in FIG. 2, for adjustably varying the pitches generated by the audio signal generator 164. Thus, the audio signal generator 164 is a means responsive to elements retrieved from the memory 138 for generating respective audio signals at respective pitches which are predetermined by the stored elements and the setting of the pitch control member 168.

The audio signal generator 164 is not only responsive to elements retrieved from the memory 138, but it is also responsive to the control signal from the first counter 70 as propagated through the first pulse generator 72, the third logic gate 77 and the transistor 79. This responsiveness occurs via the connection between the collector of the transistor 79 and the enable input 179 of the generator 164. When the audio signal generator 164 is enabled and receives a decoded signal from the element pitch decoder means 10, it provides an audio signal through output 172 to the output selector and amplifier control means 14. FIG. 2 shows that the output 172 is connected to feedback components 173 and, through a coupling capacitor, to the collector of the transistor 81.

Thus, through the decoding and generating functions of the element pitch decoder means 10 and the element pitch generator means 12 whereby an audio signal is obtained, the present invention has a means for converting elements retrieved from the internal storage means into respective audio signals.

This output of audio signals is provided to one throw contact of a second switch means 174 in the output selector and amplifier control means 14. The pole of the switch 174 is connected to the input of an integrated circuit amplifier device 176 having a plurality of resistors and capacitors connected thereto as is known in the art to provide an appropriate amount of gain to the input signal. Contained within this collection of resistors and capacitors is a volume control member 178, such as the potentiometer shown in FIG. 2. By adjusting the potentiometer 178, the volume of the output can be adjusted because changing the resistance within the potentiometer changes the gain of the amplifier 176.

Connected to the second throw contact of the switch 174 is the output from the external program source 16. FIG. 2 shows that the external program source 16 includes a microphone 180 connected to the apparatus through a microphone jack 182. The microphone jack 182 connects the microphone to a resistor-capacitor-transistor drive network 184. The output from the network 184 is connected to the second throw contact of the switch 174 for switchable connection to the amplifier 176.

Depending upon the position in which the switch 174 is placed, either the output generated from the recorded data stored within the memory 138 or the live input received from the microphone 180 is connected to the amplifier 176 for amplification and transmission to the output 18. FIG. 2 shows the output is an audio output means such as a loud-speaker 186. Thus, the output selector and amplifier control means 14 and the output means 18 provide means for audibly broadcasting the audio signals from the element pitch generator means 12.

In addition to showing the previously described elements, FIG. 2 discloses specific types of integrated circuit devices for implementing the described elements, as indicated by the component numbers shown in the figure. FIG. 2 further shows values for the particular discrete components. It is to be noted that these specific integrated circuits and discrete components have merely been disclosed to describe the preferred embodiment of the present invention, and are not to be considered as limiting the scope of the invention in any way. For example, large scale integrated circuits could be used to implement a variety of the elements which have been described with respect to the preferred embodiment. Also by way of example, the amplification portion of the invention could be implemented with operational amplifiers appropriately connected for providing adjustable gain and for driving the output 18.

Figure 3:
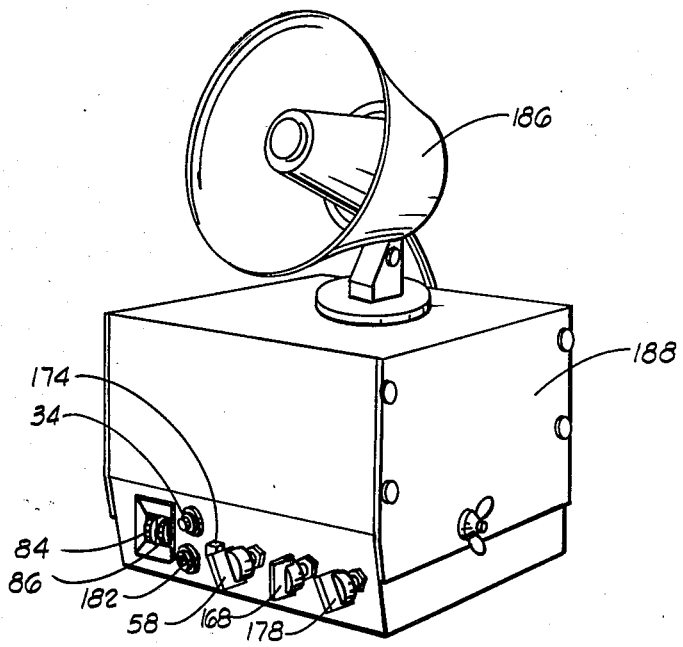
FIG. 3 is a perspective view of the external appearance of the preferred embodiment of the present invention.

FIG. 3 shows an external perspective view of the outer covering and controls of the preferred embodiment of the present invention. The loud-speaker 186 is shown mounted on a case 188. Disposed along the front of the case 188 are the thumbwheel switches 84 and 86. The activation switch 34 and the microphone jack 182 are also shown in FIG. 3. FIG. 3 further shows the output selector switch 174 and the adjustment knobs of the tempo control member 58, the pitch control member 168 and the volume control member 178. FIG. 3 further discloses that this embodiment is portable because of its relatively compact size. However, the unit may be mounted in a car or some fixed location. To accommodate this fixed location installation, the apparatus can include an attachment device such as a conventional horseshoe bracket.

With reference again to FIG. 2, the modes of operation of the preferred embodiment of the present invention will be described. The first mode of operation pertains to the broadcasting of music or other sounds recorded within the memory 138. This mode is denominated the music mode and is obtained by positioning the switch 174 so that the output from the audio signal generator 164 is connected to the input of the amplifier 176. With the switch 174 in this position, the present invention functions as an apparatus for broadcasting a preselected program having a plurality of first elements which are digitally coded representations of sound duration, and a plurality of second elements which are digitally coded representations of sound pitch. These pluralities of first and second elements are stored as pairs in respective locations in the memory 138. With respect to the previous description, the first elements are the duration memory elements obtained at the outputs 140, 142, and 144 of the memory 138, and the second elements are the pitch memory elements obtained at the outputs 148, 150, 152 and 154 of the memory 138. These elements are stored in pairs as music words at respective addresses within the memory 138.

Once the music mode has been chosen by appropriately positioning the switch 174, the particular recorded data (i.e., the particular collection of music words) to be played must be selected. This selection is made by manually entering the desired address in the thumbwheel switches 84 and 86.

With the switch 174 in the music mode and the appropriate address entered in the thumbwheel switches, the apparatus is ready to be activated by depressing the activation switch 34. When the switch 34 is depressed, the timer 30 is activated to drive the transistor 36 so that the coil 38 of the relay is energized to close the switch 40. The closure of the switch 40 connects the voltage regulator 42 and the output selector and amplifier means 14 to the main power supply.

To permit the voltage regulator 42 to stabilize when the switch 40 is initially closed, the reset circuit 24 sends a high logic level MRG signal for a short period of time as determined by the resistor-capacitor network connected to the transistor 64. The high MRG signal resets the first counter 70 and the second counter 80 to an initial state of all low logic level outputs. This output from the second counter 80 addresses the first music word within the memory 138 area designated by the setting on the thumbwheel switches 84 and 86. Additionally, the high MRG signal disables the audio signal generator 164 from sending any audio signals to the amplifier 176. This disabling occurs because the MRG signal causes a low logic level output at the output of the gate 77 to thereby maintain the transistor 79 switched off. With the transistor 79 in this status the enable input 170 is held at a high logic level so that the audio generator 164 is disabled, and the output 172 is coupled to ground through the capacitor and transistor 81 which has been switched on by the high level signal maintained by the transistor 79. The high MRG signal also causes the output of the gate 75 to be at a low logic level so that the second pulse generator 76 is also disabled.

After the predetermined MRG delay, the transistor 64 is driven into saturation to hold the MRG output at a low logic level during the remainder of the operation of the apparatus. This low output enables the first counter 70, the second counter 80 and the logic gate 77. The change of the MRG signal from a high level to a low level also causes the output of the gate 75 to switch from a low to a high level which in turn triggers the second pulse generator 76 to create a load pulse that is transmitted to the load input of the first counter 70. This load pulse enters the first duration memory element from the outputs 140, 142 and 144 of the memory 138 into the first counter 70. This first duration memory element is the one previously addressed and placed at the memory 138 outputs by means of the setting of the thumbwheel switches 84 and 86 and the MRG initialization of the second counter 80.

In addition to having the duration memory element on its outputs 140–144 as a result of the initialization process, the memory 138 has the first pitch memory element on its outputs 148, 150, 152 and 154 because this element is stored with the duration element as a single music word and is thus simultaneously accessed therewith at a single address. This pitch memory element is decoded by the decoder 156 and converted into an audio signal by the audio generator 164. The audio signal is transmitted from the generator 164 through the switch 174 to the amplifier 176 and on to the loudspeaker 186 for broadcasting thereby.

As this pitch memory element is being decoded and a corresponding audio signal generated and broadcast, the first counter 70 within the element duration control means 4 is being clocked by the timing signal from the timing circuit 22 to count from the initially loaded count provided by the first duration memory element. When the counter 70 reaches its overflow condition after having counted from the initially loaded value, it transmits a trigger signal to the first pulse generator 72. This trigger signal causes the pulse generator 72 to generate a high logic level disable and increment pulse for transmission to the respective inputs of the gates 75 and 77 and to the increment input of the second counter 80. This pulse causes the gates 75 and 77 to disable the audio generator 164 in a manner similar to that effected by the high MRG signal so that the broadcasting of the audio signal corresponding to the first pitch element is terminated. The pulse also increments the second counter 80 to its next value so that the next music word is addressed in the memory 138 and placed on the respective outputs thereof.

After a predetermined time, as established by the resistor-capacitor network 74 connected to the first pulse generator 72, the high level disable and increment pulse ceases thereby re-enabling the gates 75 and 77. As the pulse changes, the output of the gate 75 changes so that another load pulse is generated by the second pulse generator 76 for loading the newly accessed duration memory element into the first counter 70. Because a new music word has been addressed and retrieved, there is a new pitch memory element also at the respective outputs of the memory 138 for decoding and broadcasting in a manner similar to the first pitch element. Thus, in this way the various pitch elements located in the area generally addressed by the setting on the thumbwheel switches are accessed and broadcast for the respective durations as determined by the corresponding duration memory element within each word stored in the memory 138.

As this process continues, the counter 80 is eventually incremented to the point where a high logic level signal is placed on the output 98 thereof. This high level signal is transmitted to the input 112 of the memory 138 to thereby disable the memory 138. The high level signal is also transmitted to the gate 60 and to the transistor 62. The application of this signal to the gate 60 disables it so that no further clocking signals are transmitted to the first counter 70. The application of the signal at the base of the transistor 62 causes the transistor to switch on thereby pulling the reset input of the first timer 30 to ground. This resets the first timer 30 and thereby switches the transistor 36 off. This de-energizes the coil 38 of the relay. When the coil is de-energized, the contacts of the switch 40 open, thereby disconnecting the main power supply from the circuit. Thus, the apparatus is automatically shut-off when the entire selection has been broadcast as indicated and controlled by the status of the output 98 of the second counter 80.

It is to be noted that for each selection entered in the thumbwheel switches 84 and 86 in the embodiment shown in FIG. 2, there are thirty-two music words which can be addressed. This is derived from the five outputs 88, 90, 92, 94 and 96 of the second counter 80. With this number of outputs, the second counter 80 commences its addressing at address 00000 upon initialization by the high MRG signal and is then incremented through address 11111 under control of the first counter 70 and the first pulse generator 72. When count 100000 is attained by the second counter 80, the high logic level digit of this address appears on the sixth output 98 of the counter 80. As previously mentioned, this high signal disables the memory 138 and automatically switches the apparatus off to thus limit to thirty-two the number of music words addressed during any one selection chosen by the setting of the thumbwheel switches.

Also as presently shown in FIG. 2, the thumbwheel switches 84 and 86 are connected to the memory 138 so that any one of thirty-two areas, or songs, can be selected by the thumbwheel switches because of the five address lines extending from the switches to the memory 138. (It is to be noted that the possible address line extending between the output 130 and the input 136 is presently connected to ground and thereby disabled.) Therefore, with these connections any one of thirty-two songs, each having thirty-two pitch memory elements and duration memory elements as just described, can be played.

Although the preferred embodiment shown in FIG. 2 is connected for this thirty-two by thirty-two limit, it is to be noted that this limit can be modified to accommodate any number of such addresses by changing the output and input connections between the first counter 80, the switch means 82 and the memory 138 and by changing the capacity of the memory 138. For example, by breaking the strap 137, the number of songs which could be played would be increased to sixty-four with thirty-two pitches and durations in each. As another example, the strap 137 could be maintained connected to ground and the input 120 of the memory 138 could be connected to the output 98 of the counter 80. The input 112 of the memory 138 could then be connected to the next highest binary count output from the counter 80. With this arrangement, the thumbwheel switches could select any one of sixteen songs (they would be selected via the outputs 116, 118, 126 and 128) with each song containing up to sixty-four music words (this would be obtained by the six address lines and the new disable line from the second counter 80). Therefore, it is apparent that various combinations of selectable songs and numbers of words within each song can be obtained with the present invention.

During the operation of the apparatus in the music mode, various manual changes can be made by the operator of the device. For example, the tempo control member 58 (i.e., the potentiometer 58 shown in FIG. 2) can be varied by rotating the appropriate knob located on the front of the apparatus as shown in FIG. 3. By rotating the knob the effective resistance of the potentiometer 58 is varied to in turn vary the frequency of the signal generated by the second timer 54. Additionally, the pitch may be varied by manipulating the potentiometer 168 via the appropriate knob located on the front of the apparatus. The volume may also be adjusted by changing the setting of the potentiometer 178 which has a control knob also located on the front of the apparatus as shown in FIG. 3. Still another change which can be made by the operator is to replace the memory 138 with a new memory. The switchability of the memories is effected by using solid-state integrated circuit memory chips such as the previously mentioned PROMs, EPROMs or ROMs.

Because of the versatility of the apparatus of the present invention, it may be operated not only in the previously described music mode, but also in a public address, or PA, mode. This mode is selected by placing the switch 174 in the position shown in FIG. 2. With the switch 174 in this position, the microphone 180 is connected to the amplifier 176 whenever the microphone is attached to the jack 182. In this mode, live sounds can be detected by the microphone 180, amplified by the amplifier 176 and broadcast through the loud-speaker 186. Appropriate volume control is effected through the potentiometer 178.

Because of this versatility and the other previously discussed features of this apparatus, the present invention of a sound broadcasting apparatus is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for reproducing sound from data electrically stored in an electronic memory device, said apparatus comprising:

timing control means;

element duration control means including a first counter receiving input from said timing control and means providing output to a first pulse generator;

element sequence control means including a second counter controlled by said element duration control means, and including a first controllable switch means;

internal program storage means controlled by said element duration control means and said first controllable switch means to provide data output;

element pitch decoder means receiving said data output to output retrieved individual signal elements;

means for converting the retrieved elements into respective audio signals;

means for audibly broadcasting the respective audio signals.

2. An apparatus as recited in claim 1, wherein said timing control means includes:

tempo means for providing to said controlling means an electrical signal having a selectable one of a plurality of substantially constant frequencies; and means for selecting one of the frequencies.

3. An apparatus as recited in claim 1, wherein said converting means includes means, responsive to the elements retrieved from the memory, for generating the respective audio signals at respective predetermined pitches.

4. An apparatus as recited in claim 3, wherein said converting means further includes means for adjustably varying the predetermined pitches.

5. An apparatus as recited in claim 3, wherein said converting means further includes means for decoding each of the retrieved elements from a respective digital format in which each of the elements is stored to a substantially equivalent analog format.

6. An apparatus as recited in claim 1, wherein said internal program storage means includes switch means for adjustably selecting any one of a plurality of storage areas within said memory.

7. An apparatus as recited in claim 1, for also reproducing sound from externally input signals, further comprising:

an external program source generated by selected means external to the electronic memory device; and means for switchably connecting either said converting means or said external program source to said audible broadcasting means.

8. An apparatus as recited in claim 7, wherein said external program source includes a microphone.

9. Apparatus for broadcasting a preselected program having a plurality of first elements which are digitally coded representations of sound duration and a plurality of second elements which are digitally coded representations of sound pitch, said apparatus comprising:

a memory for storing the program elements; a timing means for providing an electrical signal having a selectable frequency;

a first counter, responsive to said timing means and to the sound duration elements, for controlling the broadcast duration of the pitch elements;

a second counter, responsive to said first counter means, for sequentially incrementing through the pluralities of first and second program elements;

decoding means for changing the digitally coded pitch elements to substantially equivalent single conductor analog current signals;

means, responsive to said decoding means and said first counter means, for generating an audio signal; and audio output means for broadcasting the generated audio signal.

* * * * *